US009703242B2

(12) United States Patent
Tanaka et al.

(10) Patent No.: US 9,703,242 B2
(45) Date of Patent: Jul. 11, 2017

(54) FIXING APPARATUS

(71) Applicant: CANON KABUSHIKI KAISHA, Tokyo (JP)

(72) Inventors: Masaki Tanaka, Kawasaki (JP); Masafumi Maeda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/249,678

(22) Filed: Aug. 29, 2016

(65) Prior Publication Data

US 2016/0363895 A1 Dec. 15, 2016

Related U.S. Application Data

(62) Division of application No. 14/493,630, filed on Sep. 23, 2014, now Pat. No. 9,454,118.

(30) Foreign Application Priority Data

Sep. 27, 2013 (JP) ..... 2013-201533
Sep. 3, 2014 (JP) ..... 2014-179003

(51) Int. Cl.
*G03G 15/16* (2006.01)
*G03G 15/20* (2006.01)

(52) U.S. Cl.
CPC ..... *G03G 15/2053* (2013.01); *G03G 15/2017* (2013.01); *G03G 15/2064* (2013.01)

(58) Field of Classification Search
USPC ..... 399/122, 329
See application file for complete search history.

(56) References Cited

U.S. PATENT DOCUMENTS 7,283,145 B2 10/2007 Kato et al.
7,366,455 B2 4/2008 Iwasaki et al.
(Continued)

FOREIGN PATENT DOCUMENTS

JP 9-34289 A 2/1997
JP 2011-95306 A 5/2011
JP 2011-133502 A 7/2011

OTHER PUBLICATIONS

U.S. Appl. No. 14/520,490, filed Oct. 22, 2014, to Oki Kitagawa et al.
(Continued)

*Primary Examiner* — Clayton E Laballe
*Assistant Examiner* — Warren K Fenwick
(74) *Attorney, Agent, or Firm* — Fitzpatrick, Cella, Harper & Scinto

(57) ABSTRACT

A fixing apparatus includes a first unit which contacts a surface of a fixing roller to heat the fixing roller, and a second unit which forms a fixing nip portion together with the fixing roller. A first opposing portion is provided between a shaft of the fixing roller and the first unit, such that a distance between the first opposing portion and the first unit when a pressure during a fixing processing for an image is applied to a contact region between the fixing roller and the first unit is more than 0 mm and 2 mm or less. A second opposing portion is provided between the shaft of the fixing roller and the second unit, such that a distance between the second opposing portion and the second unit when the pressure is applied to the fixing nip portion is more than 0 mm and 2 mm or less.

20 Claims, 10 Drawing Sheets

(56) References Cited

U.S. PATENT DOCUMENTS

| | | | | |
|---|---|---|---|---|
| 7,469,120 | B2 | 12/2008 | Iwasaki et al. | |
| 7,650,105 | B2 | 1/2010 | Ogawa et al. | |
| 7,796,906 | B2 * | 9/2010 | Yabuta | G03G 15/00 399/299 |
| 8,010,031 | B2 | 8/2011 | Hayashi | |
| 8,364,067 | B2 | 1/2013 | Miki et al. | |
| 8,532,530 | B2 | 9/2013 | Nishida et al. | |
| 8,655,213 | B2 | 2/2014 | Tanaka et al. | |
| 8,666,273 | B2 | 3/2014 | Tanaka | |
| 8,798,514 | B2 | 8/2014 | Tanaka et al. | |
| 8,831,493 | B2 | 9/2014 | Tanaka et al. | |
| 2008/0124141 | A1 | 5/2008 | Okada | |
| 2011/0222881 | A1 | 9/2011 | Yamada | |
| 2011/0229178 | A1 | 9/2011 | Ogawa et al. | |
| 2011/0229201 | A1 | 9/2011 | Yamada | |
| 2012/0093530 | A1 | 4/2012 | Fukumoto et al. | |
| 2013/0129364 | A1 | 5/2013 | Kitagawa et al. | |
| 2013/0206745 | A1 | 8/2013 | Tanaka et al. | |
| 2013/0272762 | A1 | 10/2013 | Uekawa et al. | |
| 2013/0302046 | A1 | 11/2013 | Monde et al. | |
| 2014/0105634 | A1 | 4/2014 | Tanaka et al. | |
| 2014/0186078 | A1 | 7/2014 | Imaizumi et al. | |
| 2014/0205307 | A1 | 7/2014 | Tanaka | |
| 2014/0255065 | A1 | 9/2014 | Takahashi | |
| 2014/0294474 | A1 | 10/2014 | Akatsuka et al. | |

OTHER PUBLICATIONS

U.S. Appl. No. 14/336,270, filed Jul. 21, 2014, to Toru Imaisumi et al.

* cited by examiner

FIXING APPARATUS

This is a divisional of U.S patent application Ser. No. 14/493,630, filed Sep. 23, 2014.

BACKGROUND OF THE INVENTION

Field of the Invention

The present invention relates to a fixing apparatus for fixing an unfixed toner image onto a recording medium.

Description of the Related Art

In an electrophotographic image forming apparatus, there is provided a fixing apparatus for fixing an unfixed toner image formed on a recording medium, such as paper, onto the recording medium by heating and pressurizing the unfixed toner image. One form of the fixing apparatus encompasses a fixing apparatus including a fixing roller having a rubber layer, for conveying a recording medium while heating the recording medium, a pressure unit for forming a fixing nip together with the fixing roller, and a heating unit for heating the fixing roller by forming a heating nip together with the fixing roller (Japanese Patent Application Laid-Open No. 2011-133502). In order to fix the unfixed toner image onto the recording medium, it is necessary to apply a predetermined amount of heat or more with respect to the recording medium and the unfixed toner. This amount of heat is determined based on the temperature of the heating unit, the time period for transmitting heat from the heating unit to the fixing roller, and the time period for applying heat from the fixing roller to the toner. Note that, the time period for transmitting heat from the heating unit to the fixing roller significantly affects the nip width of the heating nip. Further, the time period for applying heat from the fixing roller to the toner significantly affects the nip width of the fixing nip. Here, when the temperature of the heating unit is increased, the amount of heat to be applied to the unfixed toner is increased, but there is a limit to the increase in temperature from the viewpoint of the heat-resistant temperature of various members forming the fixing apparatus or the image forming apparatus, the temperature increase in the apparatus, energy saving, and the like.

Accordingly, in order to fix the unfixed toner image onto the recording medium satisfactorily, it is necessary to set the nip width of each of the fixing nip and the heating nip to be a predetermined width or more. Therefore, it is necessary to set the hardness of the fixing roller and the pressure force of the heating unit and the pressure unit with respect to the fixing roller so that the nip width reaches a predetermined width or more.

However, when the image forming apparatus has been used for a long period of time, and the image forming apparatus is approaching the end of its life, the durability of the rubber layer of the fixing roller is degraded to decrease the hardness thereof. Along with the decrease in hardness, the compression deformation amount of the rubber layer of the fixing roller increases. As a result, the torque required for driving the fixing roller increases, and the risk of damage to the fixing roller also increases. Further, when the nip width is enlarged and the heat supply to the recording medium becomes excessive, the recording medium is deformed significantly, and the stacking property of the recording medium having an image formed thereon is also degraded.

Thus, in order to solve various problems to be caused when the nip width is too large while realizing satisfactory fixing property, it is necessary to regulate two nip widths within a predetermined range while setting the two nip widths to be a predetermined width or more.

SUMMARY OF THE INVENTION

The present invention has been made in view of the above-mentioned problems, and it is an object of the present invention to provide a fixing apparatus capable of maintaining a nip width of a fixing nip and a nip width of a heating nip stably for a long period of time.

It is another object of the present invention to provide a fixing apparatus, including a fixing roller including a rubber layer, a first unit configured to be brought into contact with a surface of the fixing roller so as to heat the fixing roller, a second unit configured to form, together with the fixing roller, a fixing nip portion for nipping and conveying a recording material bearing an image, in which the image on the recording material is fixed onto the recording material through heating at the fixing nip portion, a first regulation part configured to regulate the distance between a shaft of the fixing roller and the first unit to prevent the distance from decreasing, which is caused by a pressure applied to a contact region between the fixing roller and the first unit during a fixing processing for the image; and a second regulation part configured to regulate the distance between the shaft of the fixing roller and the second unit to prevent the distance from decreasing, which is caused by pressure applied to the fixing nip portion during the fixing processing.

It is still another object of the present invention to provide a fixing apparatus, including a fixing roller including a rubber layer, a first unit configured to be brought into contact with a surface of the fixing roller so as to heat the fixing roller, a second unit configured to form, together with the fixing roller, a fixing nip portion for nipping and conveying a recording material bearing an image, in which the image on the recording material is fixed onto the recording material through heating at the fixing nip portion, a first opposing portion provided between a shaft of the fixing roller and the first unit, in which the distance between the first opposing portion and the first unit when the pressure during a fixing processing for the image and applied to a contact region between the fixing roller and the first unit is more than 0 mm and 2 mm or less, and a second opposing portion provided between the shaft of the fixing roller and the second unit, in which the distance between the second opposing portion and the second unit when the pressure during the fixing processing applied to the fixing nip portion is more than 0 mm and 2 mm or less.

It is yet another object of the present invention to provide a fixing apparatus, including a fixing roller including a rubber layer, a first unit configured to be brought into contact with a surface of the fixing roller so as to heat the fixing roller, a second unit configured to form, together with the fixing roller, a fixing nip portion for nipping and conveying a recording material bearing an image, in which the image on the recording material is fixed onto the recording material through heating at the fixing nip portion, a regulation member configured to regulate a decrease in distance between the first unit and the second unit when a pressure during a fixing processing for the image is applied to a contact region between the fixing roller and the first unit and to the fixing nip portion.

It is yet another object of the present invention to provide a fixing apparatus, including a fixing roller including a rubber layer, a first unit configured to be brought into contact with a surface of the fixing roller so as to heat the fixing roller, the first unit including a tubular film having an outer surface brought into contact with the fixing roller, and a heater configured to be brought into contact with an inner surface of the tubular film to apply a pressure to the fixing roller through the tubular film, a second unit configured to form a fixing nip portion for nipping and conveying a recording material bearing an image with the fixing roller, in which the image on the recording material is fixed onto the recording material through heating at the fixing nip portion, and an insulating regulation member configured to regulate the distance between a shaft of the fixing roller and the heater when pressure during a fixing processing for the image is applied to a contact region between the fixing roller and the first unit to prevent the distance from decreasing.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Exemplary embodiments of the present invention are described below in detail by way of examples with reference to the attached drawings. However, the dimensions, materials, shapes, relative positional relationship, and the like of components described in the embodiments are not meant to limit the scope of the present invention unless otherwise specified.

<Image Forming Apparatus>

Figure 1:
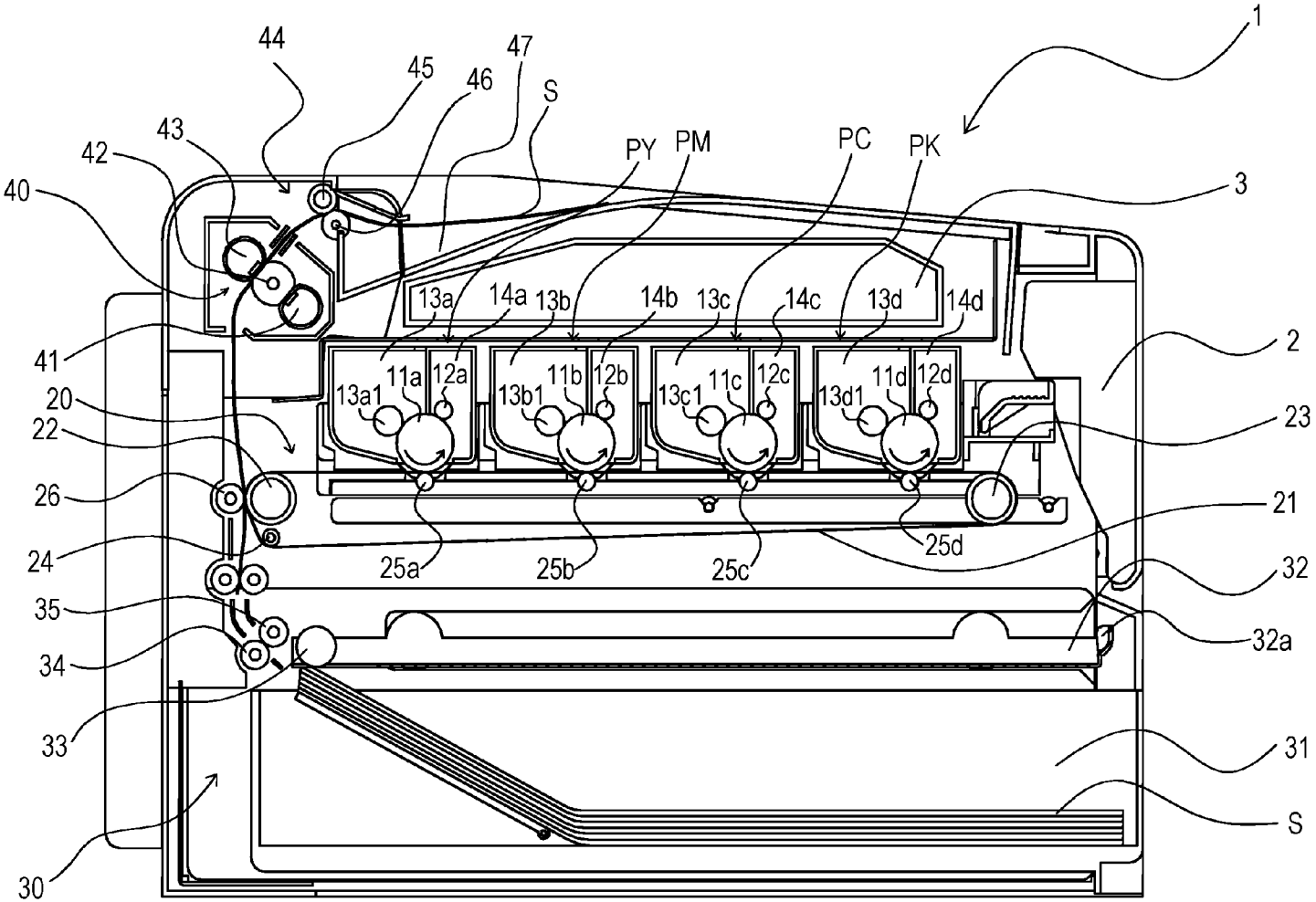
FIG. 1 is a schematic configuration view of an image forming apparatus.

An example of an image forming apparatus to which a fixing apparatus according to an embodiment of the present invention is applicable is described with reference to FIG. 1. In this case, a full-color (four-color) laser printer employing an electrophotographic process system is described as an example. Note that, FIG. 1 is a view illustrating a cross section of a schematic configuration of an image forming apparatus 1. In the following description, a front side (front surface side) of the image forming apparatus 1 refers to a side on which an apparatus opening/closing door (opening/closing member) 2 is provided, and a back side (back surface side) thereof refers to a side opposed to the front side. Further, the right and left refer to the right and left of the image forming apparatus 1 when viewed from the front side.

<<Configuration of Image Forming Apparatus>>

The image forming apparatus 1 according to this embodiment is a tandem type full-color (four-color) laser printer. As illustrated in FIG. 1, the image forming apparatus 1 includes process cartridges PY, PM, PC, PK of respective colors, which are arranged in line from the back side to the front side. In the process cartridges PY, PM, PC, PK, electrophotographic photosensitive drums 11*a*, 11*b*, 11*c*, 11*d* are respectively arranged in cartridge frames. Further, in the respective cartridge frames, charging rollers 12*a*, 12*b*, 12*c*, 12*d* each configured to uniformly charge the surface of the corresponding photosensitive drum are also provided. Further, in the respective cartridge frames, developing units 13*a*, 13*b*, 13*c*, 13*d* each configured to develop an electrostatic latent image formed on the corresponding photosensitive drum are also provided. The respective developing units 13*a*, 13*b*, 13*c*, 13*d* include developing rollers 13*a*1, 13*b*1, 13*c*1, 13*d*1, and each developing unit contains a developer (toner). Further, in the respective cartridge frames, cleaning units 14*a*, 14*b*, 14*c*, 14*d* each configured to remove a residual toner remaining on the surface of the corresponding photosensitive drum are also provided.

A laser scanner unit 3 is provided above a region in which the respective cartridges PY, PM, PC, PK are arranged. The laser scanner unit 3 outputs laser light in accordance with input image information, and scans and exposes the surface of each photosensitive drum. As a result, the electrostatic latent image is formed on each photosensitive drum.

An intermediate transfer belt unit 20 is provided below the region in which the respective cartridges PY, PM, PC, PK are arranged. The intermediate transfer belt unit 20 includes a flexible endless belt 21 made of a dielectric, which serves as an intermediate transfer member. Further, the intermediate transfer belt unit 20 includes a drive roller 22, a turn roller 23, and a tension roller 24 in order to circularly move the endless belt 21 in a tensioned state. On an inner side of the endless belt 21, four primary transfer rollers 25*a*, 25*b*, 25*c*, 25*d* are arranged so as to be opposed to the respective photosensitive drums 11*a*, 11*b*, 11*c*, 11*d*. Further, a secondary transfer roller 26 is provided so as to be opposed to the drive roller 22 through the endless belt 21.

The respective cartridges PY, PM, PC, PK, the laser scanner unit 3, the intermediate transfer belt unit 20, the primary transfer rollers 25*a*, 25*b*, 25*c*, 25*d*, and the second transfer roller 26 each described above are main constituent members of an image forming mechanism for forming an unfixed toner image onto a recording medium.

A sheet feeding portion 30 for feeding sheets S such as paper serving as a recording medium is provided below the endless belt 21. The sheet feeding portion 30 includes a sheet cassette 31 on which the sheets S before the formation of an image are stacked and a conveyance path through which the manually fed sheet S is conveyed. Further, the sheet feeding portion 30 includes a feed roller 33 for feeding the sheets S, a separation roller 34 for separating the sheets S into one sheet, and a conveyance roller 35 for conveying the sheet S to a downstream side. Note that, the sheet cassette 31 and the conveyance path 32 are formed removably from the front side of the image forming apparatus 1.

In the image forming apparatus 1, a fixing apparatus 40 for fixing an unfixed toner image onto the sheet S is provided on a downstream side in the conveyance direction of the sheet S conveyed by the sheet feeding portion 30. Further, a delivery roller pair 44 for delivering the sheet S having a toner image fixed thereon by the fixing apparatus 40 and a tray 47 for stacking the delivered sheet S are provided. Note that, the delivery roller pair 44 is formed of a roller 45 and an idler roller 46.

The fixing apparatus 40 includes a fixing roller 42 that is rotated with a drive force transmitted from a main body of the image forming apparatus 1. Further, the fixing apparatus 40 includes a pressure unit (second unit) 43 that forms a fixing nip portion together with the fixing roller 42 so as to nip the conveyed sheet S, and a heating unit (first unit) 41 that forms a heating nip together with the fixing roller 42 so as to heat the fixing roller 42.

<<Image Forming Operation>>

Each photosensitive drum 11 is driven to rotate at a predetermined control speed in a direction of the arrow in FIG. 1. The endless belt 21 is also driven to rotate at a speed corresponding to the rotation speed of the photosensitive drum 11 in a direction conforming to the rotation of the photosensitive drum 11, and the laser scanner unit 3 is also driven at substantially the same timing. In synchronization with this drive, each charging roller 12 uniformly charges the surface of the corresponding photosensitive drum 11 to a predetermined polarity and potential at a predetermined control timing in each of the cartridge PY, PM, PC, PK. The laser scanner unit 3 scans and exposes the surface of each photosensitive drum 11 in accordance with an image signal of each color. Thus, a region of the surface of each photosensitive drum 11 scanned with and exposed to the laser light becomes an electrostatic latent image in accordance with the image signal. Then, the electrostatic latent image formed on the surface of each photosensitive drum 11 is developed as a toner image by each developing unit 13. The toner image formed on each photosensitive drum 11 is transferred onto the endless belt 21. Due to the above-mentioned electrophotographic image forming process operation, the unfixed toner images of the respective colors are formed on the endless belt 21 in a superimposed manner.

On the other hand, the sheets S in the sheet cassette 31 are fed one by one by the separation roller 34 and the conveyance roller 35 at a predetermined control timing. Then, the unfixed toner images on the endless belt are transferred onto the sheet S conveyed to a nip between the secondary transfer roller 26 and the endless belt 21. Then, the sheet S is separated from the surface of the endless belt 21 and fed to the fixing apparatus 40. The sheet S is heated and pressurized at the fixing nip, and the unfixed toner image of each color is fixed onto the sheet S in a color-mixed state. The sheet S is delivered onto the tray 47 for stacking the delivered sheet S by the delivery roller pair 44 through the fixing apparatus 40.

(First Embodiment)

The fixing apparatus 40 according to a first embodiment of the present invention is described with reference to FIGS. 2A to 8B.

<Fixing Apparatus>

Figure 2A:
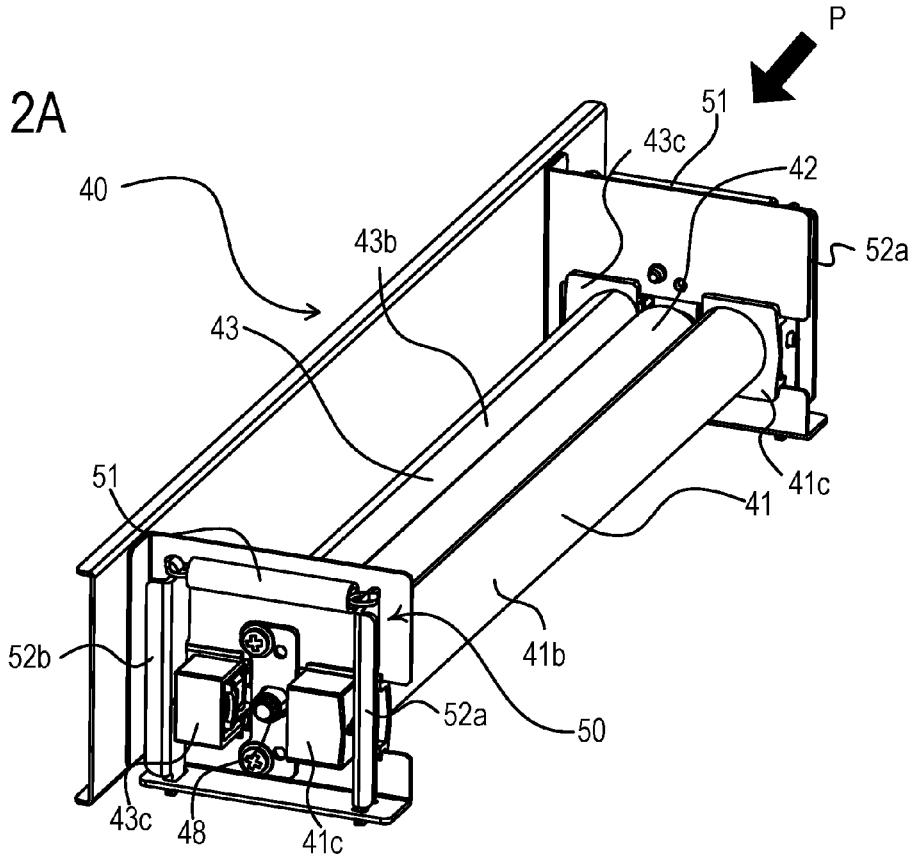
FIGS. 2A and 2B are schematic perspective views of a fixing apparatus according to a first embodiment of the present invention.
Figure 2B:
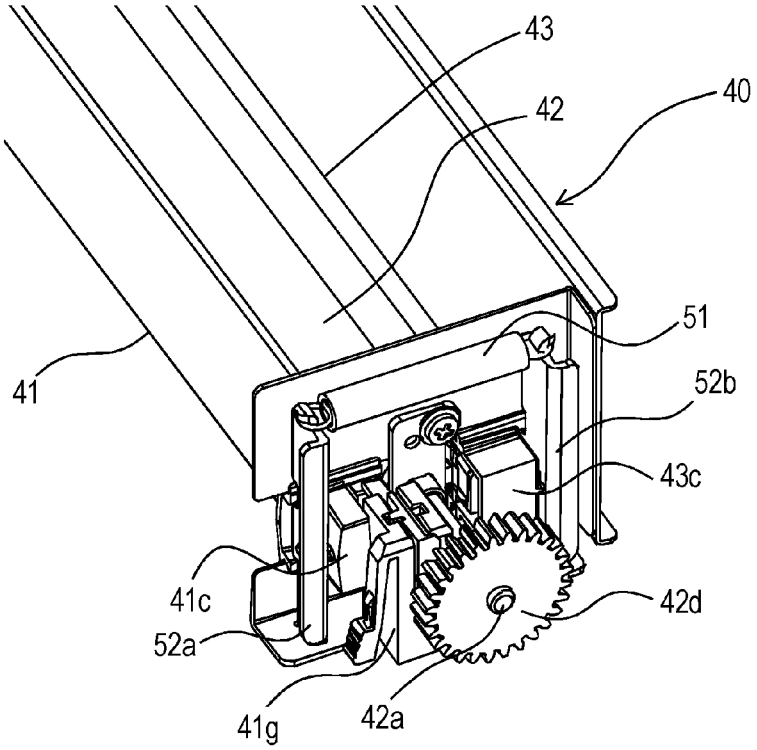
Figure 3:
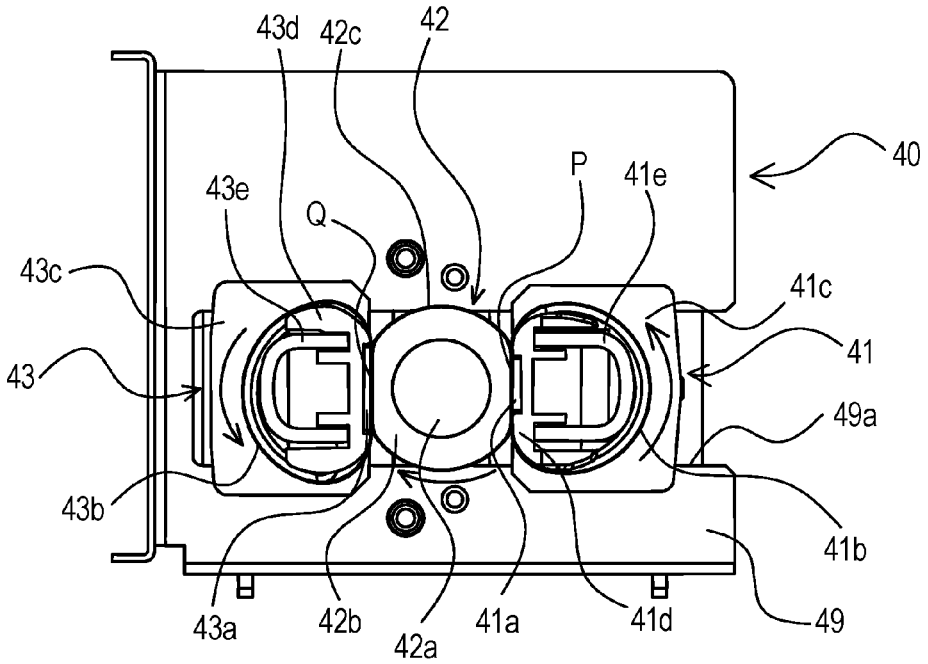
FIG. 3 is a schematic sectional view of the fixing apparatus according to the first embodiment.
Figure 4:
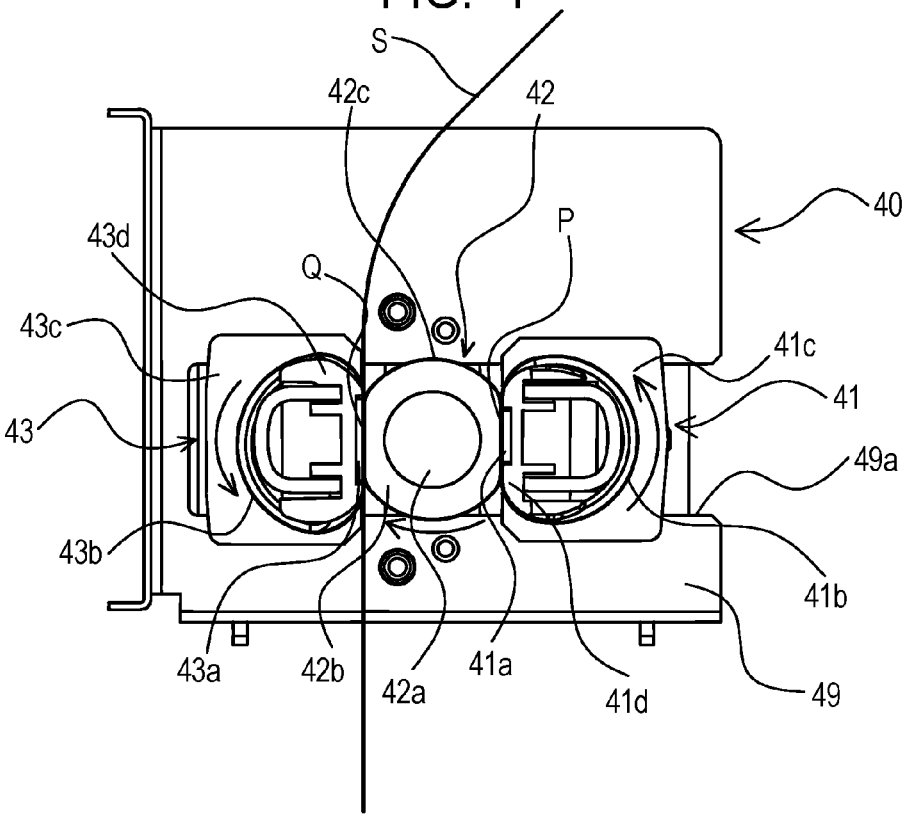
FIG. 4 is a schematic sectional view of the fixing apparatus according to the first embodiment.

The entire configuration of the fixing apparatus 40 and the operation thereof are described with reference to FIGS. 2A, 2B, 3, and 4 in particular. FIG. 2A is a perspective view illustrating a schematic configuration of the fixing apparatus 40 according to the first embodiment of the present invention. FIG. 2B is a view of the fixing apparatus 40 when viewed from a direction of the arrow P of FIG. 2A. FIGS. 3 and 4 are sectional views illustrating a schematic configuration of the fixing apparatus 40 according to the first embodiment of the present invention. Note that, FIGS. 3 and 4 are sectional views taken along a line in a direction perpendicular to a rotation center axis line of the fixing roller 42. Further, FIG. 3 illustrates a state in which the sheet S is not passing through the fixing apparatus 40, and FIG. 4 illustrates a state in which the sheet S is passing through the fixing apparatus 40.

As described above, the fixing apparatus 40 includes the heating unit (first unit) 41, the fixing roller 42, and the pressure unit (second unit) 43. The fixing roller 42 is arranged so as to be interposed between the pressure unit 43 and the heating unit 41. Further, the heating unit 41 and the pressure unit 43 are held so as to slide in a direction of interposing the fixing roller 42 therebetween by a rim 49*a* forming a groove provided in a frame (made of a metal) 49 of the fixing apparatus 40. The slide direction (direction A of FIG. 5) and the direction in which a force is applied by a force applying mechanism 50 described later are parallel to each other.

The fixing roller 42 is formed of a cored bar portion (roller shaft) 42*a*, an elastic layer (rubber layer) 42*b* formed on an outer circumferential surface side of the cored bar portion 42*a*, and a surface layer (fluorine resin layer) 42*c* formed on an outer circumferential surface side of the elastic layer 42*b*. The fixing roller 42 is supported rotatably by the frame 49 of the fixing apparatus 40 through a bearing member 48. Further, the fixing roller 42 rotates in the arrow direction of FIGS. 3 and 4 with a drive force transmitted from the main body of the image forming apparatus 1. As illustrated in FIG. 2B, a gear 42*d* to be driven with a motor (not shown) is mounted on the shaft 42*a* of the fixing roller 42.

The heating unit 41 includes a heat-generating member 41*a* for generating heat with electric power supplied from a commercial power source, and an endless heating film 41*b* that rotates in the arrow direction of FIGS. 3 and 4 along with the rotation of the fixing roller 42 so as to slide along the heat-generating member 41*a*. The heat-generating member 41*a* is a plate-like member (ceramic heater) in which a resistance heating element is formed on a ceramic substrate. A power supply connector 41*g* is mounted on an end portion of the heat-generating member 41*a* as illustrated in FIG. 2B. The heat-generating member 41*a* generates heat with electric power supplied through the connector 41*g*. Thus, the heating unit (first unit) 41 includes the tubular heating film 41*b* having an outer surface brought into contact with the fixing roller 42, and the heat-generating member 41*a* that is brought into contact with an inner surface of the heating film 41*b* to apply a pressure to the fixing roller 42 through the heating film 41*b*. Further, the heating unit 41 includes a guide member 41*c* for guiding the rotation of the heating film 41*b* and regulating the movement thereof in a longitudinal direction (direction parallel to the rotation center axis line of the fixing roller 42), and a holder 41*d* made of a heat-resistant resin, for holding the heat-generating member 41*a*. As illustrated in FIGS. 2A and 2B, the guide members 41*c* (two in total) are respectively provided at positions opposed to each other in end portions of the heating film 41*b*. A stay 41*e* made of a metal has a U-shaped cross section, for reinforcing the holder 41*d*. The stay 41*e* is held in contact with a surface of the holder 41*d* on an opposite side of a heater holding surface thereof, and the length of the stay 41*e* extends from one guide member 41*c* to the other guide member 41*c*. A guide groove 41*cg* serves to fit the heating unit 41 into the rim 49*a* forming the groove of the frame 49 and is formed on the guide member 41*c*.

The pressure unit 43 includes an endless pressure film 43*b* that rotates in the arrow direction of FIGS. 3 and 4 along with the rotation of the fixing roller 42, and a sliding member 43*a* that is provided so that the pressure film 43*b* slides. The sliding member 43*a* is an aluminum plate that is a plate-like member made of a rigid body. Thus, the pressure unit (second unit) 43 includes the tubular pressure film 43*b* having an outer surface brought into contact with the fixing roller 42, and the sliding member 43*a* that is brought into contact with an inner surface of the pressure film 43*b* to apply a pressure to the fixing roller 42 through the pressure film 43*b*. Further, the pressure unit 43 includes a guide member 43*c* for guiding the rotation of the pressure film 43*b* and a holder 43*d* for holding the sliding member 43*a*. A guide groove 43*cg* serves to fit the pressure unit 43 into the rim 49*a* forming the groove of the frame 49 and is formed on the guide member 43*c*. As illustrated in FIG. 3, in a circumferential direction of the fixing roller 42, the pressure unit (second unit) 43 is held in contact with the surface of the fixing roller 42 at a position on the surface of the fixing roller 42 different from a position on the surface of the fixing roller 42 with which the heating unit (first unit) 41 is brought into contact. More specifically, the heating unit 41, the fixing roller 42, and the pressure unit 43 are held by the frame 49 of the fixing apparatus 40 so as to be arranged on a straight line in the stated order.

In the fixing apparatus 40 according to this embodiment, the force applying mechanism 50 for applying a force to the pressure unit 43 and the heating unit 41 in a direction of interposing the fixing roller 42 therebetween is provided.

<Force Applying Mechanism>

The force applying mechanism 50 is described with reference to FIGS. 2A and 5 in particular. The force applying mechanism 50 is provided at each end of the fixing roller 42. Note that, the force applying mechanism 50 provided at one end has the same configuration as that of the force applying mechanism 50 provided at the other end. The force applying mechanism 50 includes a pair of pressure plates 52*a*, 52*b*. The pressure plate 52*a* serves to pressurize the heating unit 41, and the pressure plate 52*b* serves to pressurize the pressure unit 43. The force applying mechanism 50 includes a tension spring 51 for tensioning the pair of pressure plates 52*a*, 52*b* in a slide direction of the heating unit 41 and the pressure unit 43. The tension force of the tension spring 51 is applied to the pressure unit 43 and the heating unit 41 in a direction of interposing the fixing roller 42 therebetween through the pair of pressure plates 52*a*, 52*b*. That is, the heating unit (first unit) 41 and the pressure unit (second unit) 43 are urged toward the fixing roller 42 by the common tension spring 51. The force of the tension spring 51 is transmitted from the pressure plate 52*a* to the guide member 41*c*, the stay 41*e*, the holder 41*d*, the heat-generating member 41*a*, the heating film 41*b*, and the fixing roller 42 in the stated order. Similarly, the force of the tension spring 51 is transmitted from the pressure plate 52*b* to the guide member 43*c*, a stay 43*e*, the holder 43*d*, the sliding member 43*a*, the pressure film 43*b*, and the fixing roller 42 in the stated order.

The fixing roller 42 is pressed from both sides by the heating unit 41 and the pressure unit 43 with the force applying mechanism 50 configured as described above, and the elastic layer 42*b* is deformed so as to be compressed. Thus, a heating nip P is formed by the fixing roller 42 and the heating unit 41, and a fixing nip Q is formed by the fixing roller 42 and the pressure unit 43. In this case, the surface of a part of the heating unit 41 that pressurizes the fixing roller 42 and the surface of a part of the pressure unit 43 that pressurizes the fixing roller 42 both have a planar shape. The heating unit 41 and the pressure unit 43 pressurize the fixing roller 42 with the tension force of one tension spring 51 at each end in the axial direction of the fixing roller 42, and hence the force of the heating unit 41 pressing the fixing roller 42 is equal to the force of the pressure unit 43 pressing the fixing roller 42. Further, along with this, the compression deformation amount of the fixing roller 42 by the heating unit 41 is equal to that of the fixing roller 42 by the pressure unit 43. Note that, the compression deformation amount of the fixing roller 42 is determined based on the hardness of the elastic layer 42*b* of the fixing roller 42 and the tension force of the tension spring 51. When the compression deformation amount of the fixing roller 42 increases, the nip width of each of the heating nip P and the fixing nip Q is enlarged.

<Fixing Process>

Next, a process of fixing an unfixed toner image onto the sheet S in the fixing apparatus 40 is described with reference to FIG. 4 in particular. The surface of the fixing roller 42 is heated at the heating nip P with the heat generated by the heat-generating member 41*a* provided on the heating unit 41. Due to the rotation of the fixing roller 42, the heated part of the surface of the fixing roller 42 is moved to the fixing nip Q. Thus, at the fixing nip Q, the conveyed sheet S is heated and pressurized together with the unfixed toner formed on the sheet S. Accordingly, the unfixed toner image is fixed onto the sheet S.

The fixing property in this case is determined based on the amount of heat applied to the sheet S and the unfixed toner image on the sheet S at the fixing nip Q. That is, the fixing property is determined based on the temperature of the heat-generating member 41*a* and the nip width (width in the circumferential direction of the fixing roller 42) of each of the fixing nip Q and the heating nip P.

Therefore, it is necessary to set the temperature of the heat-generating member 41*a*, the hardness of the fixing roller 42, and the tension force of the tension spring 51 so as to satisfy the fixing property. Note that, as described in the "Description of the Related Art" section, when the fixing roller 42 has been used for a long period of time, the durability thereof is degraded to decrease the rubber hardness. When the degradation of durability decreases the rubber hardness, the compression deformation amount of the fixing roller 42 increases to cause various problems.

In the fixing apparatus 40 according to this embodiment, a regulation member 100 is provided so that the compression deformation amount of the fixing roller 42 does not exceed a predetermined amount. The regulation member 100 is hereinafter described with reference to FIGS. 5 to 8B.

<Regulation Member>

Figure 5:
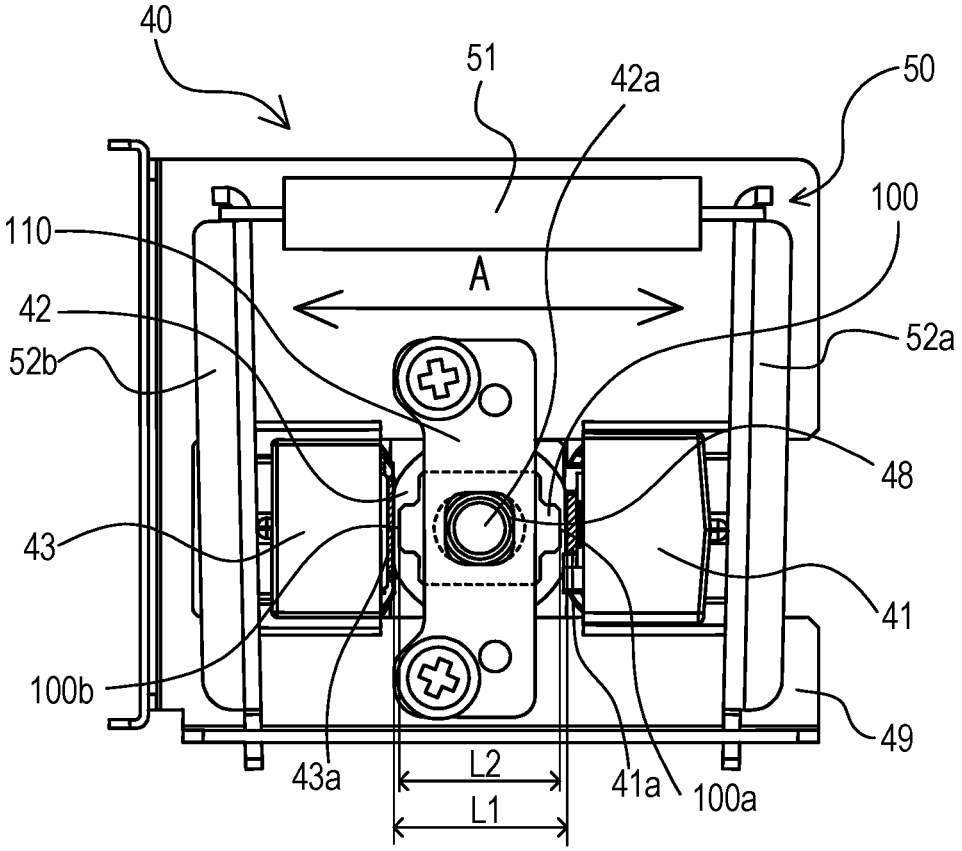
FIG. 5 is a schematic sectional view of the fixing apparatus according to the first embodiment.
Figure 6A:
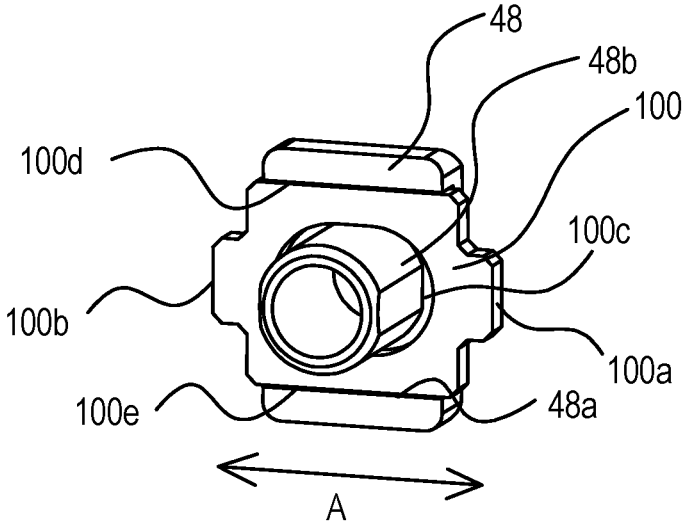
FIGS. 6A and 6B are perspective views of a regulation member according to the first embodiment.
Figure 6B:
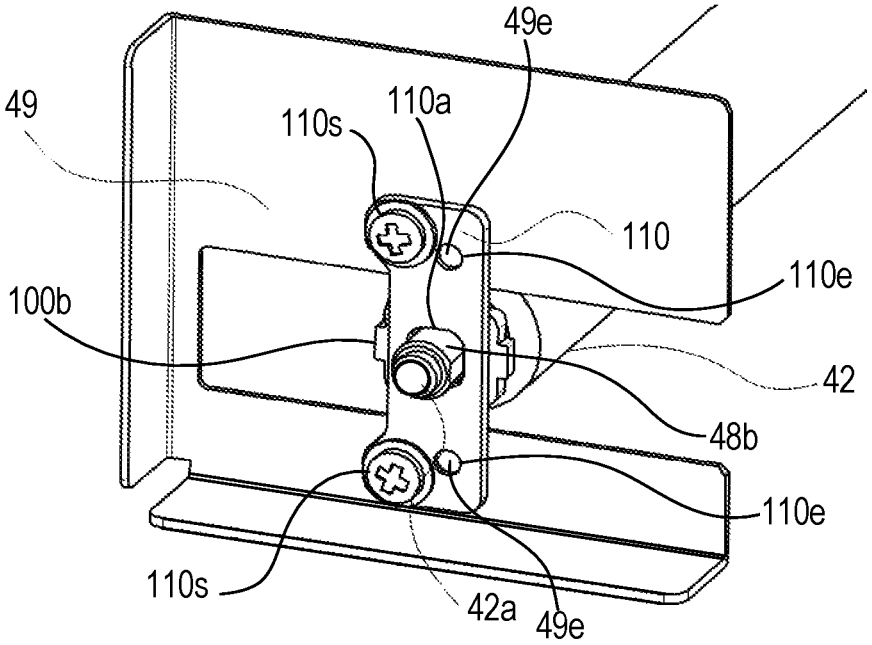
Figure 7:
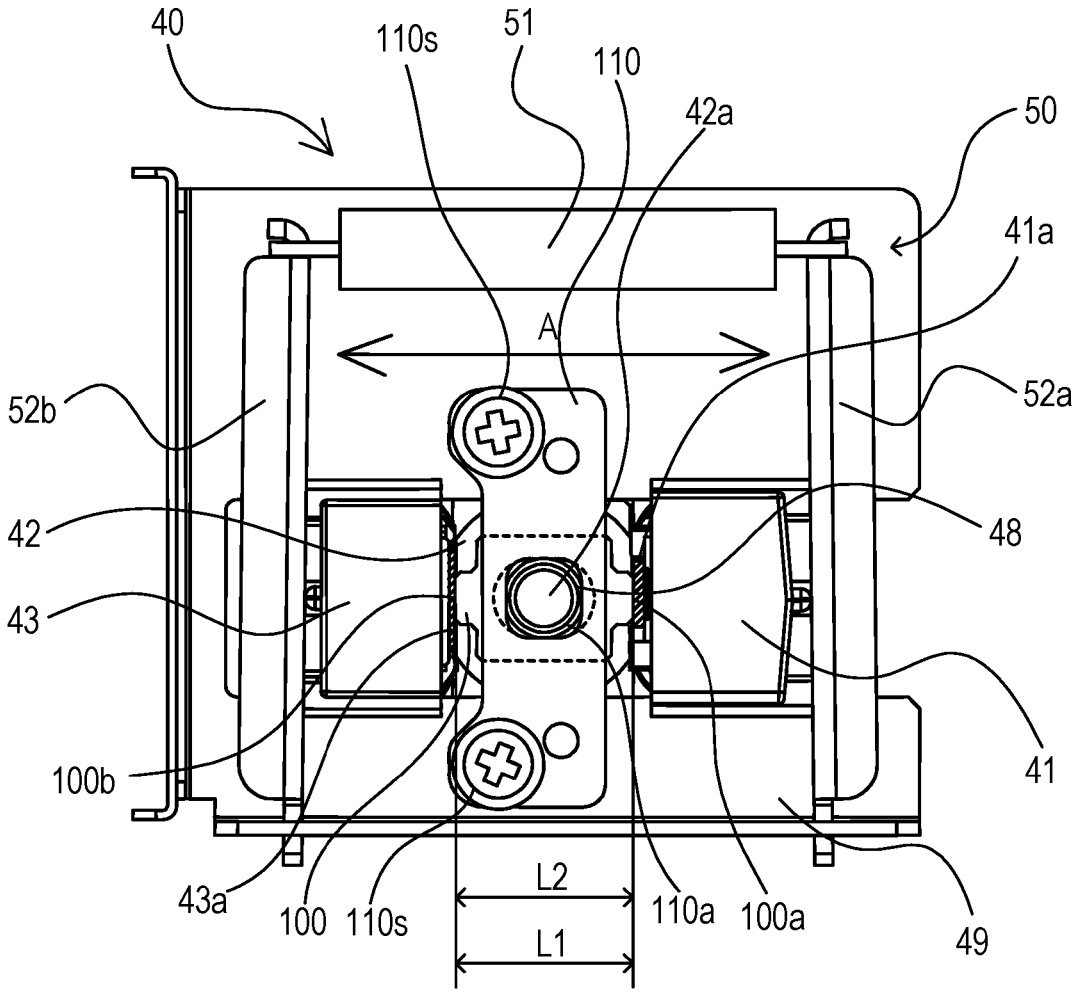
FIG. 7 is a schematic sectional view of the fixing apparatus according to the first embodiment.
Figure 8A:
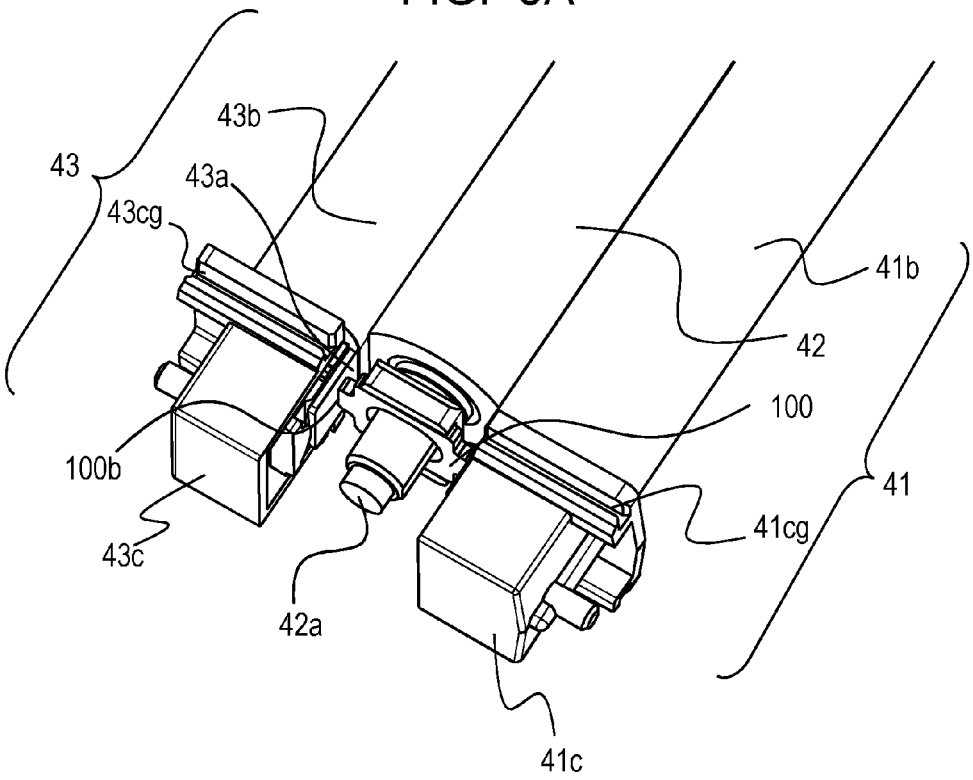
FIGS. 8A and 8B are perspective views of the vicinity of a region in which the regulation member is provided.
Figure 8B:
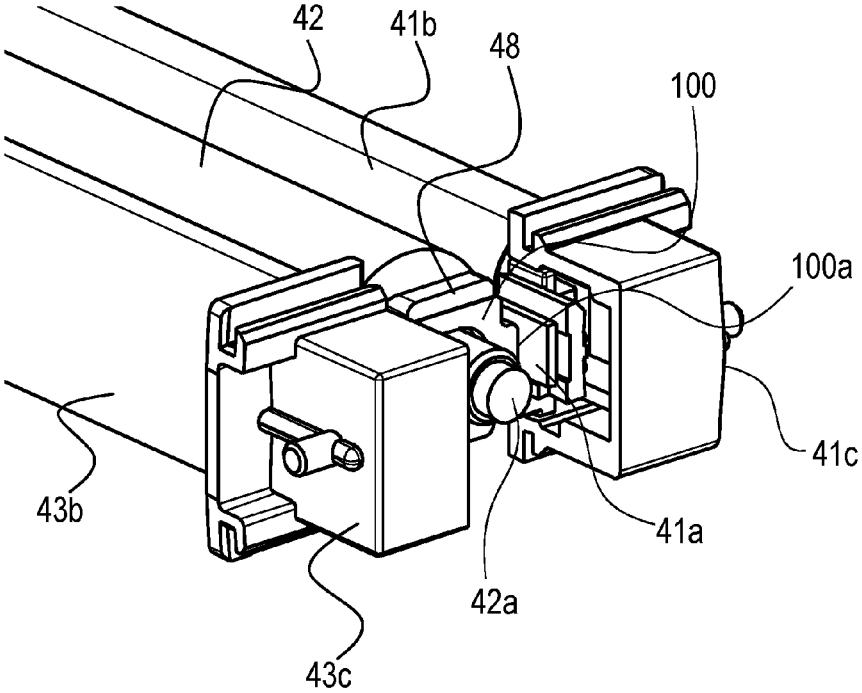

FIGS. 5 and 7 are sectional views each illustrating a schematic configuration of the fixing apparatus 40 according to the first embodiment of the present invention. Note that, FIGS. 5 and 7 are sectional views taken along a line in a direction perpendicular to the rotation center axis line of the fixing roller 42. Further, FIG. 5 illustrates a state before the rubber layer 42*b* of the fixing roller 42 is degraded, and FIG. 7 illustrates a state in which the rubber layer of the fixing roller 42 has been degraded. FIGS. 6A and 6B are perspective views each illustrating a relationship between the bearing member 48 and the regulation member 100. FIGS. 8A and 8B are perspective views of the vicinity of a region in which the regulation member 100 is provided. FIG. 8A is a perspective view illustrating a relationship between a regulation surface 100*b* of the regulation member 100 and the sliding member 43*a*, and FIG. 8B is a perspective view illustrating a relationship between a regulation surface 100*a* of the regulation member 100 and the heat-generating member 41*a*.

The regulation member 100 serves to regulate the movement of the pressure unit 43 and the heating unit 41 so that the distance between the pressure unit 43 and the heating unit 41 does not become a predetermined distance or less. The regulation member 100 is provided at each end in the axial direction of the fixing roller 42. Note that, the regulation member 100 provided at one end has the same configuration as that of the regulation member 100 provided at the other end. Further, the regulation member 100 is arranged between the heat-generating member 41*a* and the sliding member 43*a*. The degradation degree of the rubber layer 42*b* of the fixing roller 42, the force of the tension spring 51, and the like have an individual difference (tolerance) depending on each individual apparatus. Thus, in the case where the regulation member 100 according to this embodiment is not provided, there may be an individual apparatus in which the width of each of the heating nip P and the fixing nip Q hardly becomes larger even when the apparatus is used until the predetermined end of its life. However, simultaneously, there may be an individual apparatus in which the width of each of the heating nip P and the fixing nip Q becomes too large when the apparatus is used until the predetermined end of its life. The regulation member 100 according to this embodiment functions in the individual apparatus in which the width of each of the heating nip P and the fixing nip Q becomes too large when the apparatus is used until the predetermined end of its life.

End surfaces of the regulation member 100 on both sides in the slide direction A serve as the regulation surfaces 100*a* and 100*b* that regulate the movement of the heating unit 41 and the pressure unit 43 when the heating unit 41 and the pressure unit 43 abut against the regulation surfaces 100*a* and 100*b*, respectively, in the case where the rubber layer 42*b* of the fixing roller 42 collapses excessively. The regulation surface 100*a* corresponds to a first regulation part for regulating the decrease in distance between the shaft of the fixing roller and the first unit 41 when the pressure during the fixing processing is applied to the contact region (heating nip portion P) between the fixing roller 42 and the first unit 41. The regulation surface 100*a* also corresponds to a first opposing portion provided between the shaft of the fixing roller 42 and the first unit 41. On the other hand, the regulation surface 100*b* corresponds to a second regulation part for regulating the decrease in distance between the shaft of the fixing roller 42 and the second unit 43 when the pressure during the fixing processing is applied to the fixing nip portion Q. The regulation surface 100*b* also corresponds to a second opposing portion provided between the shaft of the fixing roller 42 and the second unit 43. Note that, the distance between the first opposing portion and the first unit 41 when the pressure during the fixing processing is applied to the contact region between the fixing roller 42 and the first unit 41 is preferably more than 0 mm and 2 mm or less. Further, the distance between the second opposing portion and the second unit 43 when the pressure during the fixing processing is applied to the fixing nip portion Q is preferably more than 0 mm and 2 mm or less.

In this embodiment, the length of the heat-generating member 41*a* (length in the center axis line direction of the fixing roller 42) is set to be larger than the length of the heating film 41*b* in a generatrix direction. Further, similarly, the length of the sliding member 43*a* is set to be larger than that of the pressure film 43*b* in the generatrix direction. As a result, the heat-generating member 41*a* of the heating unit 41 and the sliding member 43*a* of the pressure unit 43 directly abut against the regulation surfaces 100*a* and 100*b* of the regulation member 100.

Further, a long hole 100*c* that extends in the slide direction A is formed at the center of the regulation member 100. A tubular portion 48*b* provided on the bearing member 48 is inserted into the long hole 100*c*. Note that, the inner circumferential side of the tubular portion 48*b* serves as a bearing of the cored bar portion 42*a* of the fixing roller 42. Further, the regulation member 100 is configured so that surfaces 100*d*, 100*e* slide along a groove 48*a* extending in the slide direction A and being provided on the bearing member 48 when the regulation member 100 is fitted in the groove 48*a*. Due to the above-mentioned configuration, the regulation member 100 can also move in the slide direction A. Note that, a stopper (holding member) 110 fixed to the frame 49 prevents the regulation member 100 from coming off from the cored bar portion 42*a*. The stopper 110 includes a hole portion 110*a* for holding the shaft of the fixing roller 42 (through the bearing member 48) to hold the fixing roller 42 rotatably. The stopper 110 is made of a metal and fixed to the frame 49 with screws 110*s* (see FIGS. 6B and 7). The tubular portion 48*b* of the bearing member 48 is fitted in the hole portion 110*a*, and the hole portion 110*a* also serves to position the fixing roller 42 in the slide direction A and a direction perpendicular to the slide direction A. Thus, the stopper 110 serves to determine the position of the fixing roller 42, and hence is formed of a metallic (iron in this embodiment) component so as not to be bent easily upon the application of a load from the tension spring 51. Note that, the stopper 110 is positioned at protrusions 49*e* (see FIG. 6B) provided at the frame 49. Therefore, the fixing roller 42 is positioned at the frame 49 through the bearing member 48 and the stopper 110.

The heat-generating member 41*a* includes a resistance heating element on a ceramic substrate and further includes an insulating layer (for example, glass) formed so as to cover the resistance heating element. The insulating layer is held in contact with the inner surface of the heating film 41*b*. The heat-generating member 41*a* is supplied with electric power from a commercial power source. When a lightning surge voltage is applied to the heat-generating member 41*a*, discharging occurs between the resistance heating element of the heat-generating member 41*a* and the metallic component closest to the heat-generating member 41*a*, and there is a risk in that the insulating layer of the heat-generating member 41*a* may be damaged. When the stopper 110 is formed of a metallic component as described above, there is a risk in that discharging may occur between the heat-generating member 41*a* and the stopper 110. However, in this embodiment, the regulation member 100 prevents the distance between the heat-generating member 41*a* and the stopper 110 from becoming too small, and hence the discharging between the heat-generating member 41*a* and the stopper 110 can be prevented and the damage of the insulating layer of the heat-generating member 41*a* can also be prevented. Thus, an insulating component (made of resin in this embodiment) is used for the regulation member 110 so as to prevent discharging.

In an initial use period (new product state or state in which the new product has not been used so much) of the fixing apparatus 40, the compression deformation amount of the fixing roller 42 is small. Thus, a distance L1 between the heat-generating member 41*a* and the sliding member 43*a* is larger than a distance L2 between the regulation surfaces 100*a*, 110*b* of the regulation member 100. In this state, the regulation member 100 is away from the heating unit 41 and the pressure unit 43, and hence their movements do not need to be regulated (see FIG. 5). Even in the case where the compression deformation amount of the fixing roller 42 increases with the passage of time, when the distance L1 is larger than the distance L2, the regulation member 100 does not regulate the movements of the heating unit 41 and the pressure unit 43. Even when the regulation member 100 is brought into contact with any one of the heat-generating member 41*a* and the sliding member 43*a*, the regulation member 100 is capable of sliding and hence does not regulate the movements of the heat-generating member 41*a* and the sliding member 43*a*. Note that, in the initial use period, L1–L2 is preferably set to 4 mm (=2 mm+2 mm) or less. In this embodiment, L1–L2 is set to 1.6 mm (=0.8 mm+0.8 mm).

When the image forming apparatus 1 has been used for a long period of time and is approaching the end of its life, the degradation with the passage of time decreases the roller hardness of the fixing roller 42, and the compression deformation amount thereof increases. When the distance L1 and the distance L2 become equal to each other consequently, the heating unit 41 (heat-generating member 41*a*) and the pressure unit 43 (sliding member 43*a*) abut against the regulation surfaces 100*a* and 100*b* of the regulation member 100, respectively. Note that, even when any one of the heating unit 41 and the pressure unit 43 abuts against the regulation surface 100*a* or 100*b* of the regulation member 100 in advance, the regulation member 100 slides. Therefore, both the heating unit 41 and the pressure unit 43 abut against the regulation surfaces 100*a* and 100*b* of the regulation member 100, respectively, in the end. Accordingly, the distance between the heating unit 41 and the pressure unit 43 does not become less than the predetermined distance L2.

<Excellent Points of Fixing Apparatus and Image Forming Apparatus According to this Embodiment>

In the fixing apparatus 40 configured as described above and the image forming apparatus 1 including the fixing apparatus 40, the distance between the heating unit and the pressure unit 43 provided in the fixing apparatus 40 can be suppressed from becoming less than the predetermined distance L2. As a result, the compression deformation amount of the fixing roller 42 can be suppressed from becoming the predetermined width or more. Further, along with this, the nip width of each of the fixing nip Q and the heating nip P can be suppressed from becoming larger. That is, even when the degradation with the passage of time exacerbates the decrease in the roller hardness of the fixing roller 42, the enlargement of the nip width of each of the fixing nip Q and the heating nip P can be suppressed to fall within a predetermined range. Thus, the nip width of each of the fixing nip Q and the heating nip P can be maintained stably for a long period of time.

Further, in this embodiment, the heat-generating member 41*a* of the heating unit 41 and the sliding member 43*a* of the pressure unit 43 directly abut against the regulation surfaces 100*a* and 100*b* of the regulation member 100, respectively. This configuration prevents the distance between the heating unit 41 and the pressure unit from becoming less than the predetermined distance (distance between the regulation surfaces 100*a* and 100*b*) L2. Therefore, the variation in minimum distance between the heating unit 41 and the pressure unit 43 encompasses only the variation in distance L2 between the regulation surfaces 100*a* and 100*b* of the regulation member 100. Accordingly, the accuracy of the minimum distance between the heating unit 41 and the pressure unit 43 can be enhanced.

As described above, the fixing apparatus 40 according to this embodiment can maintain satisfactory fixing property for a long period of time. Further, the damage risk of the fixing roller 42 can also be reduced. Further, the increase in torque required for rotating the fixing roller 42 can also be reduced. Further, the deformation of the sheet S after the passage through the fixing apparatus 40 can be suppressed, and hence the stacking property of the sheet S having an image formed thereon is not degraded.

(Second Embodiment)

FIGS. 9 to 12B illustrate a second embodiment of the present invention. In the first embodiment, the regulation member is configured so as to move with respect to the cored bar portion (substantially cylindrical portion of the bearing member) of the fixing roller. In contrast, in this embodiment, the bearing member of the cored bar portion of the fixing roller is allowed to have a function as the regulation member. The other configurations and functions are the same as those of the first embodiment. Therefore, the same components are denoted by the same reference symbols, and the descriptions thereof are omitted.

Figure 9:
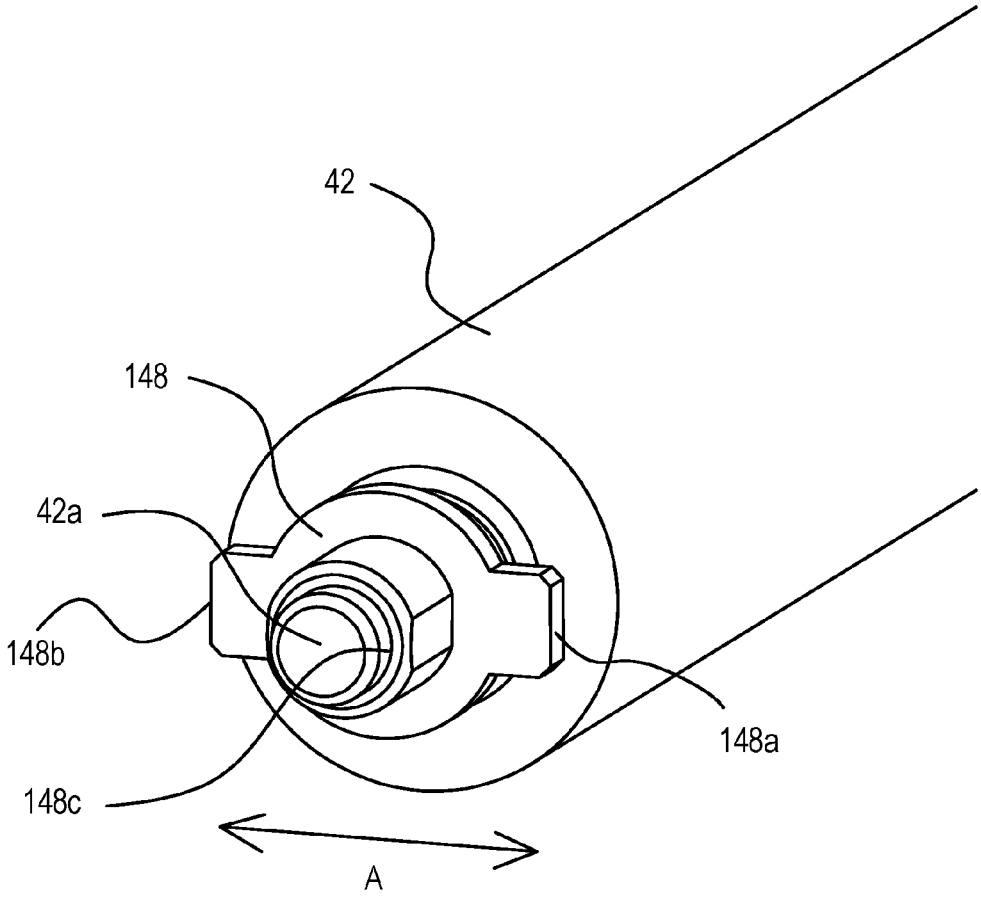
FIG. 9 is a perspective view of a bearing member according to a second embodiment of the present invention.
Figure 10:
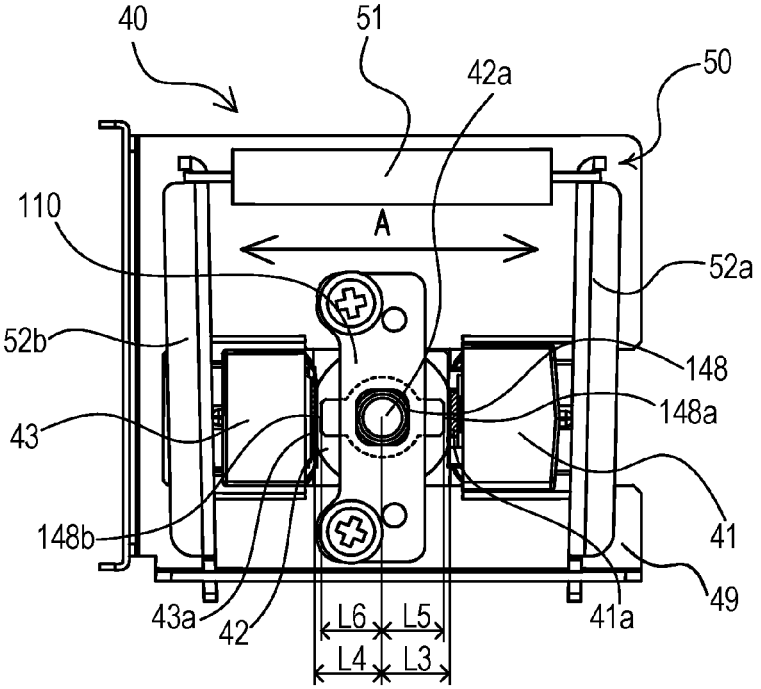
FIG. 10 is a schematic sectional view of a fixing apparatus according to the second embodiment.
Figure 11:
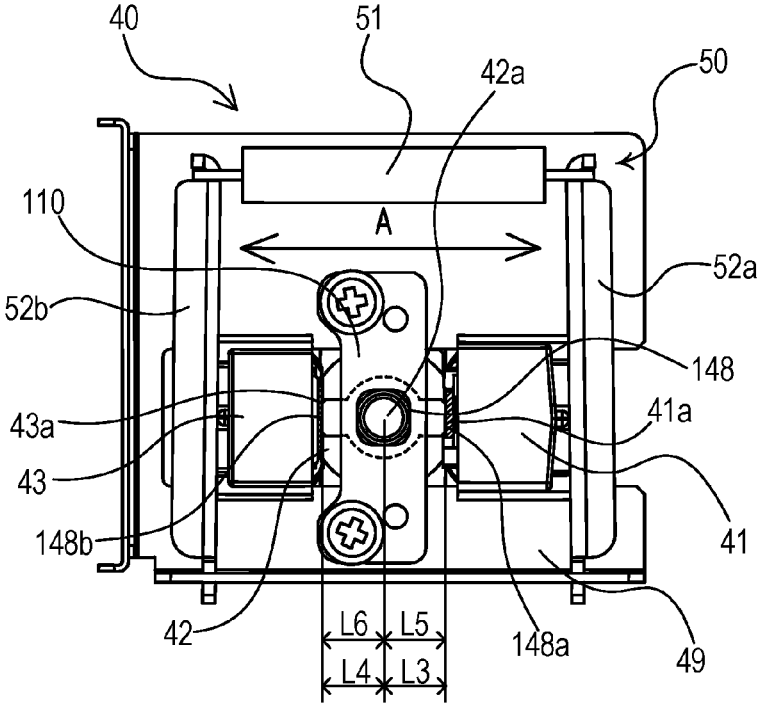
FIG. 11 is a schematic sectional view of the fixing apparatus according to the second embodiment.
Figure 12A:
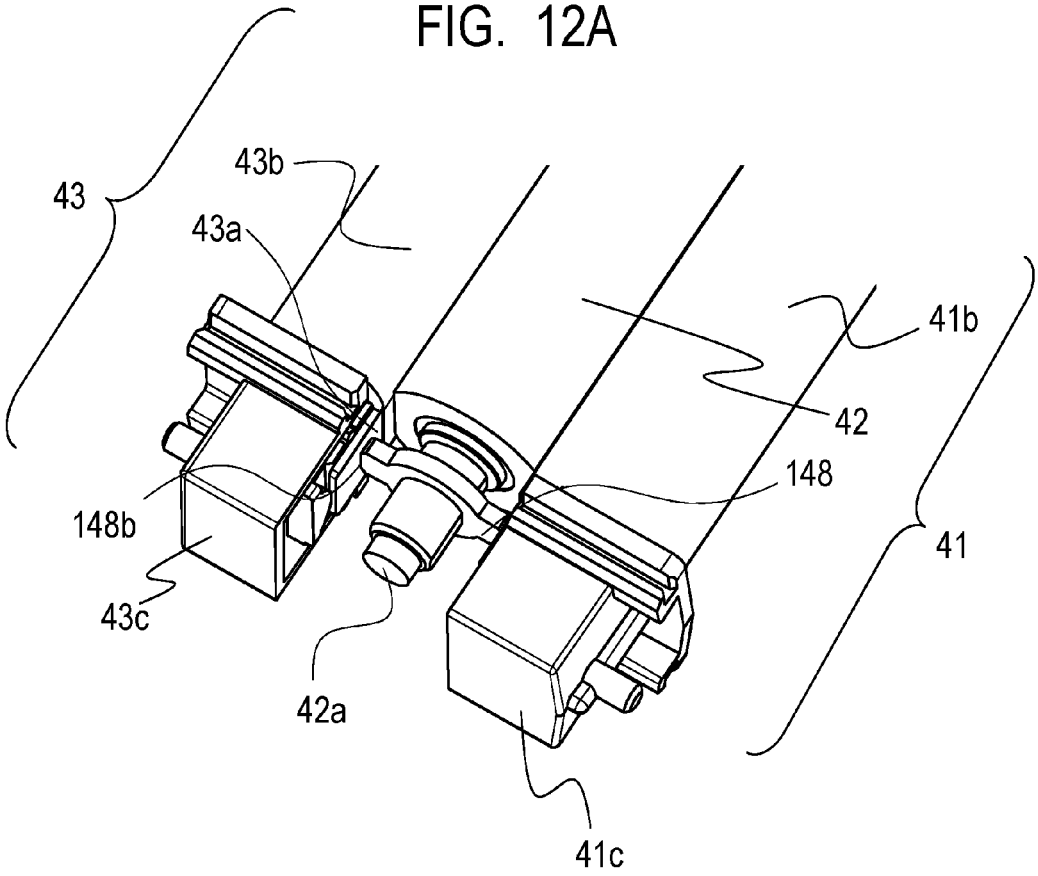
FIGS. 12A and 12B are perspective views of the vicinity of a region in which a regulation member is provided.
Figure 12B:
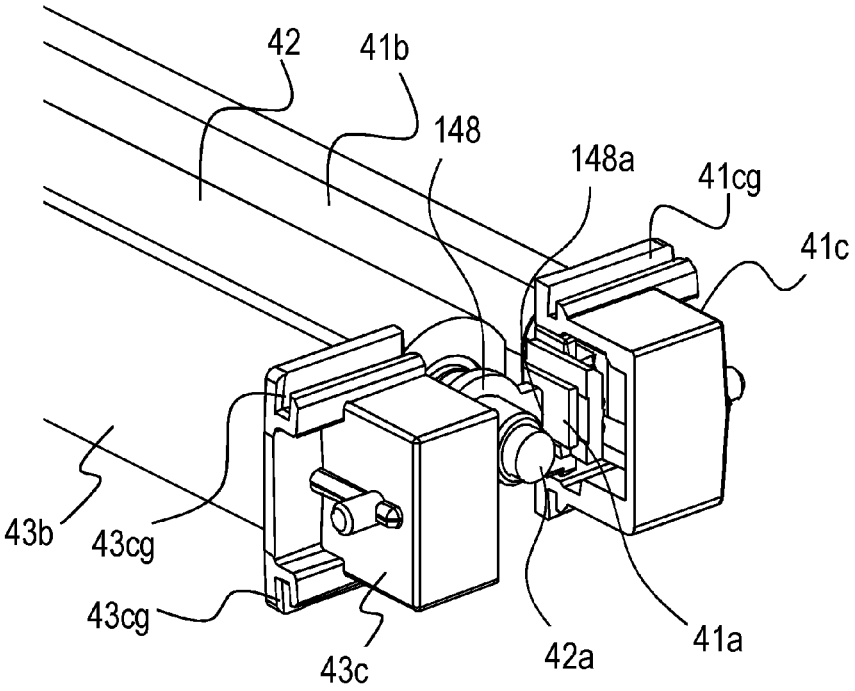

FIG. 9 is a perspective view of the vicinity of a region in which a bearing member 148 is provided. FIGS. 10 and 11 are sectional views each illustrating a schematic configuration of the fixing apparatus 40 according to the second embodiment of the present invention. Note that, FIGS. 10 and 11 are sectional views taken along a line in a direction perpendicular to the rotation center axis line of the fixing roller 42. Further, FIG. 10 illustrates a state before the fixing roller 42 is degraded, and FIG. 11 illustrates a state in which the fixing roller 42 has been degraded. FIG. 12A is a perspective view illustrating a relationship between a regulation surface 148*b* of the bearing member 148 and the sliding member 43*a*, and FIG. 12B is a perspective view illustrating a relationship between a regulation surface 148*a* of the bearing member 148 and the heat-generating member 41*a*.

In this embodiment, the fixing roller 42 is also supported rotatably by the main body of the fixing apparatus 40 through the bearing member 148 in the same way as in the first embodiment. Unlike the bearing member 48 in the first embodiment, the bearing member 148 in this embodiment also serves as the regulation member 100 in the first embodiment. The bearing member 148 is hereinafter described in detail.

The bearing member 148 is provided at each end of the fixing roller 42. Note that, the bearing member 148 provided at one end has the same configuration as that of the bearing member 148 provided at the other end.

In the bearing member 148, end surfaces on both sides in the slide direction A serve as the regulation surfaces 148*a* and 148*b* that regulate the movement of the heating unit 41 and the pressure unit 43 when the heating unit 41 and the pressure unit 43 abut against the regulation surfaces 148*a* and 148*b*, respectively. The regulation surface 148*a* corresponds to a first regulation part (first opposing portion), and the regulation surface 148*b* corresponds to a second regulation part (second opposing portion). Further, a hole 148*c* for a bearing through which the cored bar portion 42*a* of the fixing roller 42 is inserted is formed at the center of the bearing member 148. Note that, the stopper 110 fixed to the fixing frame 49 prevents the bearing member 148 from coming off from the cored bar portion 42*a*.

For convenience of the description, a distance from the center of the bearing member 148 (center of the hole 148*c*) to the regulation surface 148*a* is defined as L5, and a distance from the center of the bearing member 148 to the regulation surface 148*b* is defined as L6. Further, a distance from the rotation center of the fixing roller 42 to the heating unit 41 is defined as L3, and a distance from the rotation center of the fixing roller 42 to the pressure unit 43 is defined as L4.

The bearing member 148 is designed so as to satisfy a relationship of L5=L6. In the case where the compression deformation amount of the fixing roller 42 is small, and a relationship of L5<L3 is satisfied, the bearing member 148 is away from the heating unit 41 and does not regulate the movement of the heating unit 41. Further, similarly, in the case where a relationship of L6<L4 is satisfied, the bearing member 148 is away from the pressure unit 43 and does not regulate the movement of the pressure unit 43 (see FIG. 10). In the initial use period of the apparatus, it is preferred that both L3–L5 and L4–L6 be set to more than 0 mm and 2 mm or less. In this embodiment, L3–L5 and L4–L6 are both set to 0.8 mm.

When the image forming apparatus has been used for a long period of time and is approaching the end of its life, the degradation with the passage of time decreases the roller hardness of the fixing roller 42, and the compression deformation amount increases. When the distance L5 and the distance L3 become equal to each other consequently, the heating unit 41 (more specifically, the heat-generating member 41*a*) abuts against the regulation surface 148*a* of the bearing member 148. Similarly, when the distance L6 and the distance L4 become equal to each other, the pressure unit 43 (more specifically, the sliding member 43*a*) abuts against the regulation surface 148*b* of the bearing member 148 (see FIG. 11).

Note that, in this embodiment, as is understood from the description of the force applying mechanism 50 in the first embodiment, the distance L3 and the distance L4 become equal to each other in terms of design.

When any one of the heating unit 41 and the pressure unit 43 abuts against the regulation surface 148*a* or 148*b* of the bearing member 148 in advance, the one which abuts against the regulation surface 148*a* or 148*b* cannot move any more. Therefore, the other moves toward the bearing member 148, and both the heating unit 41 and the pressure unit 43 abut against the regulation surfaces 148*a* and 148*b* of the bearing member 148, respectively, in the end. Accordingly, the distance between the heating unit 41 and the pressure unit 43 does not become less than the predetermined distance (distance L2 between the regulation surfaces 148*a* and 148*b* in the bearing member 148).

In the fixing apparatus 40 configured as described above and the image forming apparatus 1 including the fixing apparatus 40, the same functions and effects as those of the first embodiment can also be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2013-201533, filed Sep. 27, 2013, and No. 2014-179003, filed Sep. 3, 2014, which are hereby incorporated by reference herein in their entirety.

What is claimed is:

1. A fixing apparatus, comprising:

a fixing roller including a rubber layer;

a first unit configured to be brought into contact with a surface of the fixing roller so as to heat the fixing roller;

a second unit configured to form a fixing nip portion for nipping and conveying a recording material bearing an image with the fixing roller, wherein the image on the recording material is fixed onto the recording material through heating at the fixing nip portion;

a first opposing portion provided between a shaft of the fixing roller and the first unit, wherein a distance between the first opposing portion and the first unit when a pressure during a fixing processing for the image is applied to a contact region between the fixing roller and the first unit is more than 0 mm and 2 mm or less; and a second opposing portion provided between the shaft of the fixing roller and the second unit, wherein a distance between the second opposing portion and the second unit when the pressure during the fixing processing is applied to the fixing nip portion is more than 0 mm and 2 mm or less.

2. A fixing apparatus according to claim 1, wherein the first opposing portion and the second opposing portion are provided in a single component, which is provided to slide in a direction parallel to a pressure applying direction for forming the fixing nip portion at the shaft of the fixing roller.

3. A fixing apparatus according to claim 1, wherein the first opposing portion and the second opposing portion are provided at a bearing for holding the shaft of the fixing roller.

4. A fixing apparatus according to claim 1, further comprising a frame configured to hold the first unit, the fixing roller, and the second unit so that the first unit, the fixing roller, and the second unit are arranged on a straight line in the stated order.

5. A fixing apparatus according to claim 4, wherein the first unit and the second unit are urged toward the fixing roller by a common spring.

6. A fixing apparatus according to claim 1, wherein the first unit comprises:

a tubular film having an outer surface brought into contact with the fixing roller; and a heater configured to be brought into contact with an inner surface of the tubular film to apply a pressure to the fixing roller through the tubular film.

7. A fixing apparatus according to claim 6, wherein the first opposing portion is arranged to be opposed to the heater.

8. A fixing apparatus according to claim 1, wherein the second unit comprises:

a tubular film having an outer surface brought into contact with the fixing roller; and a sliding member configured to be brought into contact with an inner surface of the tubular film to apply a pressure to the fixing roller through the tubular film.

9. A fixing apparatus according to claim 8, wherein the second opposing portion is arranged to be opposed to the sliding member.

10. A fixing apparatus, comprising:

a fixing roller including a rubber layer;

a first unit configured to be brought into contact with a surface of the fixing roller so as to heat the fixing roller;

a second unit configured to form a fixing nip portion for nipping and conveying a recording material bearing an image with the fixing roller, wherein the image on the recording material is fixed onto the recording material through heating at the fixing nip portion;

a regulation member configured to regulate a decrease in distance between the first unit and the second unit when a pressure during a fixing processing for the image is applied to a contact region between the fixing roller and the first unit and to the fixing nip portion.

11. A fixing apparatus according to claim 10, wherein the regulation member is provided to slide in a direction parallel to a pressure applying direction for forming the fixing nip portion at a shaft of the fixing roller.

12. A fixing apparatus according to claim 10, wherein the regulation member is provided at a bearing for holding a shaft of the fixing roller.

13. A fixing apparatus according to claim 10, further comprising a frame configured to hold the first unit, the fixing roller, and the second unit so that the first unit, the fixing roller, and the second unit are arranged on a straight line in the stated order.

14. A fixing apparatus according to claim 13, wherein the first unit and the second unit are urged toward the fixing roller by a common spring.

15. A fixing apparatus according to claim 10, wherein the first unit comprises:

a first tubular film having an outer surface brought into contact with the fixing roller; and a heater configured to be brought into contact with an inner surface of the first tubular film to apply a pressure to the fixing roller through the first tubular film, and wherein the second unit comprises:

a second tubular film having an outer surface brought into contact with the fixing roller; and a sliding member configured to be brought into contact with an inner surface of the second tubular film to apply a pressure to the fixing roller through the second tubular film.

16. A fixing apparatus according to claim 15, wherein the regulation member regulates a distance between the heater and the sliding member when the pressure during the fixing processing is applied to the contact region between the fixing roller and the first unit and to the fixing nip portion to prevent the distance from decreasing.

17. A fixing apparatus, comprising:

a fixing roller including a rubber layer;

a first unit configured to be brought into contact with a surface of the fixing roller to heat the fixing roller, the first unit comprising:

a tubular film having an outer surface brought into contact with the fixing roller; and a heater configured to be brought into contact with an inner surface of the tubular film to apply a pressure to the fixing roller through the tubular film;

a second unit configured to form a fixing nip portion for nipping and conveying a recording material bearing an image with the fixing roller, wherein the image on the recording material is fixed onto the recording material through heating at the fixing nip portion; and an insulating regulation member configured to regulate a distance between a shaft of the fixing roller and the heater when a pressure during a fixing processing for the image is applied to a contact region between the fixing roller and the first unit to prevent the distance from decreasing.

18. A fixing apparatus according to claim 17, further comprising a holding member made of a metal and configured to hold the fixing roller in a rotatable manner, the holding member comprising a hole portion for holding the shaft of the fixing roller.

19. A fixing apparatus according to claim 17, wherein the second unit comprises:

a tubular film having an outer surface brought into contact with the fixing roller; and a sliding member configured to be brought into contact with an inner surface of the tubular film to apply a pressure to the fixing roller through the tubular film.

20. A fixing apparatus according to claim 19, wherein the insulating regulation member comprises a regulation part for regulating a distance between the shaft of the fixing roller and the sliding member when the pressure during the fixing processing is applied to the fixing nip portion to prevent the distance between the shaft of the fixing roller and the sliding member from decreasing.

* * * * *